United States Patent [19]

D'Alessio et al.

[11] Patent Number: 4,671,382

[45] Date of Patent: Jun. 9, 1987

[54] SCAFFOLDING SYSTEM FOR SLOPED SURFACES

[75] Inventors: Michael S. D'Alessio, Flushing; Stanley A. Sandler, New York, both of N.Y.; Gary Smith, New Milford; Gerald Herman, Rutherford, both of N.J.

[73] Assignee: Harsco Corporation, Camp Hill, Pa.

[21] Appl. No.: 887,231

[22] Filed: Jul. 21, 1986

[51] Int. Cl.[4] ..... E04G 1/36

[52] U.S. Cl. ..... 182/128; 182/179; 52/638

[58] Field of Search ..... 182/128, 179, 178, 45; 52/638

[56] References Cited

U.S. PATENT DOCUMENTS

| | | | |
|---|---|---|---|
| 1,090,856 | 3/1914 | Johnson | 182/128 |
| 3,252,199 | 5/1966 | Dossner | 182/128 |
| 3,613,832 | 10/1971 | Dunster | 182/179 |
| 4,015,395 | 4/1977 | Gostling | 182/179 |
| 4,136,785 | 1/1979 | McDevitt | 182/178 |
| 4,493,578 | 1/1985 | D'Alessio | 182/178 |
| 4,496,026 | 1/1985 | Meehan | 182/128 |
| 4,527,363 | 7/1985 | Saether | 52/638 |

*Primary Examiner*—Reinaldo P. Machado
*Attorney, Agent, or Firm*—A. T. S. Safford

[57] ABSTRACT

A scaffolding support assembly particularly useful as a base for modularized post-and-runner type scaffolding used on the interior of boilers or similar large interior spaces having sloping bottom walls when employed for inspection, repair, maintenance, etc. Such scaffolding support assembly preferably comprising a scaffolding post swivel base having pivotably attached thereto longitudinally adjustable stabilizing diagonals having a connector assembly at the free end of said diagonal for securing to a connector, preferably lower, on an adjacent scaffolding post. The resulting scaffolding system has unique versatility and ease in rapidity of assembly because the swivel bases rest on the sloping sides without attachment thereto, being stabilized in position by the adjustable diagonals.

26 Claims, 17 Drawing Figures

SCAFFOLDING SYSTEM FOR SLOPED SURFACES

FIELD OF THE INVENTION

This invention generally relates to the field of scaffolding and more particularly to temporary interior scaffolding systems particularly useful for inspection, repair, maintenance, etc. of boilers or similar large interior spaces with sloping bottom walls having small manholes or similar limited size access openings.

BACKGROUND OF THE INVENTION

Fossil fueled steam boilers are commonly used throughout the world for steam generation for electrical power companies, for pulp wood and paper mills, etc. These are typically high pressure, high temperature, high capacity boilers often well over 100 feet in height and adaptable to a variety of fuels including pulverized coal, natural gas and oil and even paper mill waste slurries. In order to facilitate steam generation, most modern boiler furnaces have inner walls consisting of an array of tubes or passages through which water is circulated.

Boilers are constructed in a wide variety of sizes and shapes (which are largely determined by the power requirements and the type of fuel to be used). While most boilers are typically rectangular in plan, the height may vary considerably. The bottom of the boiler may be flat, slightly sloped, or more commonly of "V" shape with the bottom of the "V" open to allow for coal ash to fall into an ash trough.

In the case of coal burning systems and, to a lesser extent with oil, a very important operational consideration is the presence of ash and noncombustible particulates in the fuel. During operation of the boiler, these byproducts of combustion accumulate on the boiler walls and floors to create a deleterious insulating condition. This accumulation not only reduces the amount of heat absorbed by the water jacket, but also increases draft loss, reduces efficiency, corrodes pressure parts, and eventually can force shutdown of the boiler unit for cleaning, maintenance and repairs. The sulfur containing residues in the paper mill boilers can be particularly noxious and corrosive, causing piping blowouts.

A formal inspection and maintenance program is essential to the continuous safe and efficient operation of any power generating boiler. Prior to the initiation of any maintenance and repair procedure an interior scaffolding latticework must be erected within the boiler combustion chamber to provide the necessary platform for a number of workmen simultaneously and efficiently to clean and repair the inside boiler wall. The installation of the necessary scaffolding represents a considerable expense both in labor and material as well as lost revenues due to the down time of the boilers and the associated steam turbines. It is extremely important in such an installation to keep boiler outages and downtime to a minimum. Reportedly, the cost to a power utility to shut down a boiler can run as high as several hundred thousand dollars per day depending on power costs and power demands.

The type of scaffolding which can be used is limited, because access openings to the boiler interiors are normally very limited in size and number. Often there is only one manhole opening available which typically ranges in diameter only from 18 to 30 inches. The throat opening to the ash pit may be 2½ feet wide, but often must be planked over to protect maintenance workers in the ash pit (and is therefore not available as an access). Furthermore, access to the ash pit itself can be similarly limited. Normal scaffolding frames would not fit and thus cannot be used for such jobs.

Early methods employed suspended scaffolding (which was slow and difficult to use). Only a few workers could be accommodated at a given time. Custom built wooden scaffolding and then tube-and-coupler scaffolding were apparently also used at one time. Although accommodating of more workers, these also were too slow and costly. Later, a standing latticework of modularized post-and-runner type scaffolding began to be used. To erect and support such scaffolding, one had to weld fixed support members at precise, previously determined, locations along the sloped converging bottom walls of the boiler. The scaffolding latticework was then installed inside the boiler with support being provided by vertical posts which were either mounted to the welded support on the sloping bottom walls of the boiler or to a truss spanning the throat. In this method, the entire weight of the scaffolding was transmitted directly to and supported by such bottom walls through these weldments. These approaches created several problems both in installation and removal. The positioning and welding of the support members along the lower converging boiler walls had to be precisely arranged in order to properly support the modularized scaffolding system. Both of these requirements necessitated a labor force with higher skill levels that further increased labor costs. Also, the physical welding of each of the support members was labor intensive and time consuming. Once maintenance, inspection and/or repair work had been completed, the scaffolding and its welded support brackets had to be removed. If left in the boiler, the brackets could not be relied upon to survive intact, because of the hostile environment within the boiler when the firebox was in use. This breaking and removal of the weldments was a further cost and created another potential for damage to the boiler walls.

One method which has been used to eliminate the the need for the welded scaffolding support bracket on the V-shaped bottom walls is shown in U.S. Pat. No. 4,496,026. This shows a founding ladder system which provides support for a scaffolding system mounted inside a boiler. This founding ladder system (like others before it) incorporates a truss mounted horizontally in the boiler throat. Connected to the truss are ladder-like supports which extend up and rest on the inside convergingly sloped bottom walls of the boiler. These ladder-like supports through adjustable attachments provide movable bases along the sloping walls from which to erect the scaffolding system to be constructed inside the boiler. These ladder-supports also serve to redirect much of the weight from scaffolding posts down to the horizontal throat trusses, to which they are connected. This system, however, requires a large inventory of relatively specialized complex members which are expensive to fabricate, inventory and maintain. Being specialized, they have little use between boiler jobs. Also, this support system utilizing the founding ladders requires extensive modification where obstructions inherent in the converging boiler bottom walls interfere with the normal symmetric placement of the founding ladder supports.

OBJECTS OF THE INVENTION

Accordingly, it is an object of the present invention to provide a boiler throat scaffolding system which utilizes mainly standard scaffolding members with a minimum of specialized equipment and can be adapted quickly and easily to conform to various boiler interior configurations.

Another object of the present invention is to provide a scaffolding system which is not labor intensive to erect and which can be installed quickly by relatively unsophisticated workmen.

A further object of the present invention is to provide a scaffolding system constructed primarily with standard modularized post and runner type scaffolding equipment configured to support a substantial portion of the vertical forces internally within the latticework of the scaffolding.

A still further object of the present invention is to provide a scaffolding system which can be quickly and more easily adapted to compensate for any obstructions present in the converging boiler bottom walls.

SUMMARY OF THE INVENTION

The present invention solves the aforementioned problems with a novel scaffolding support assembly. With this assembly, the foot of a scaffold post rests, without attachment thereto, on a sloping surface and is tied rigidly to a point on an adjacent scaffold post thus securing the foot in position. If necessary, the adjacent post may further be tied horizontally in-line into the remainder of the scaffold latticework until balanced by a countervailing force in the scaffold system. The invention eliminates the need for installing weldments on the sloping bottom boiler walls and as compared with the system of U.S. Pat. No. 4,496,026, it also reduces the number, size and weight of specialized parts which must be employed. The present invention thus not only unexpectedly reduces the size of specialized inventory needed, but also reduces time for erecting such scaffolding in an unexpectedly simple and effective manner.

In accordance with one aspect of the present invention, the vertical uprights in the scaffold latticework have swivel bases, preferably of standard construction modified to accept stabilizing diagonals for tying into the balance of the scaffold latticework. These swivel bases can be rotated to conform to the particular angle of a sloping boiler wall or similar sloping bottom surface.

This unique supporting method and apparatus is further accomplished by pivotally connecting the swivel base, resting on the sloping wall and supporting a first vertical upright, through a unique extendable diagonal to a connector, preferably lower, on an adjacent second vertical upright. This novel positioning system allows for the transmission of a significant portion of the forces, particularly the horizontal forces, present in the first vertical upright diagonally to the second vertical upright. That force is typically further conducted without any twisting moment into the scaffold latticework at that next lower level by means of a line of horizontal members joined via in-line connectors of subsequent vertical uprights until it is balanced by a compensating force, usually of similar origin, from the other side of the latticework. Over the larger horizontal spans, such horizontals may have to be heavy duty. This arrangement is duplicated at each successive lower vertical upright which impinges the sloping bottom boiler walls.

In a boiler having the usual throat, there is provided a removable support beam or truss which spans the open throat and acts as a base for those vertical uprights necessary to support the center of the scaffolding latticework. Unlike prior systems, the feet of the uprights engaging the sloping wall are not linked by ladders (or other equipment) directly to the support trusses, and thus in the present invention the trusses do not bear the horizontal forces from such feet.

Utilizing this unique force-balancing method, the individual scaffolding latticework can be quickly and easily modified for any asymmetric configuration of a given boiler interior. Because the points of contact with the converging sloped bottom walls of the boiler are relatively few and quite small in surface area, the vertical uprights can easily be positioned to avoid obstructions inherent in such walls.

The scaffolding itself is advantageously formed utilizing standard modularized post and runner scaffolding, preferably, of the type incorporating the wedge-connected, load bearing locking rings as shown in applicant's assignee's U.S. Pat. No. 4,493,578, which patent is incorporated herein by reference.

The preferred downward diagonal is pivotally fastened at one end (via a clevis) to the modified swivel base and (via another clevis) to a connector coupling assembly at the other end with a downwardly extending finger to interfit into one of the holes in a ring connector of a vertical scaffold upright while clamping to the adjacent post portion of the latter. The diagonal preferably is made from an extension tube telescoped over a screw rod to which it is adjustably joined by a spanner nut.

The versatility of this novel system is assured by a double clevis connector coupling assembly, which permits a pair of in-line downwardly-extending diagonals to fasten respectively on opposing sides of the same ring connector of a single vertical upright. In a significant number of installations this capability may effectively be a necessity.

In an alternative diagonal, modified to handle upwardly deflected forces, the diagonal's base clevis is preferably the same, but the diagonal's opposite end has a fork-shaped fixture which serves to straddle securely by action of the compressive forces a horizontal already fastened to the ring connector at that point.

BRIEF DESCRIPTION OF THE DRAWINGS

In this specification and the accompanying drawings, applicant has shown and described several preferred embodiments of his invention and has suggested various alternatives and modifications thereto, but it is to be understood that these are not intended to be exhaustive and that many changes and modifications can be made within the scope of the invention. These suggestions herein are selected and included for purposes of illustration in order that others skilled in the art will more fully understand the invention and principles thereof and will thus be enabled to modify it and embody it in a variety of forms, each as may be best suited to the conditions of a particular use.

DETAILED DESCRIPTION OF PREFERRED EMBODIMENTS

Figure 1:
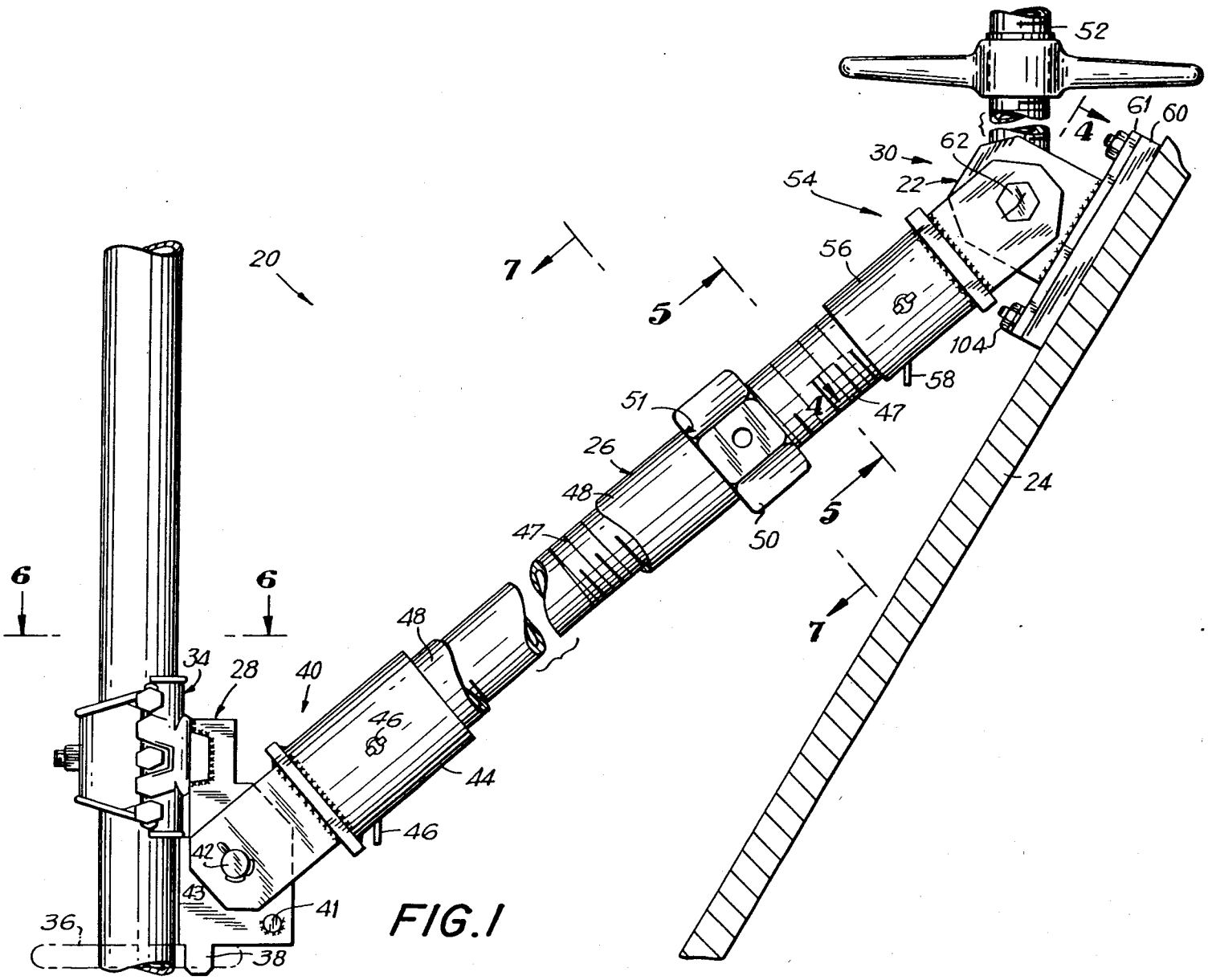
FIG. 1 is a side elevation of the adjustable diagonal with a base clevis pivoted on the swivel base (shown resting on a sectioned portion of the sloping boiler bottom) and with a connector clevis pivoted on the connector coupling assembly (shown positioned on a vertical post whose ring connector is illustrated in dash-dot outline)

Referring first to FIG. 1, a scaffolding support assembly of one embodiment of the present invention is shown generally at 20. This support assembly 20 includes a swivel base 22 which bears directly on the sloping boiler bottom wall 24 and is pivotally connected to a longitudinally adjustable heavy diagonal 26 which in turn is pivotally connected to a connector coupling assembly 28. As shown in FIG. 1, the scaffolding support assembly 20 secures the foot 30 of a vertical scaffold post 32 on the sloping wall 24 by tieing the foot 30 to an adjacent inner scaffolding post 32 through its adjustable diagonal 26. This scaffolding support assembly 20 totally eliminates the necessity for boiler ladders, ladder spacers, ladder hooks and adjustable brackets as required in the "ladder-type" prior art boiler founding systems.

The connector coupling assembly 28 of FIG. 1 further comprises a coupler 34 for clamping to the inner vertical post 32 at ring connector 36 (shown in phantom). The assembly 28 engages ring connector 36 by means of a downwardly extending finger 38 which interfits into one of the holes in ring connector 36.

A connector clevis 40 is pivotally carried on the connector coupling assembly 28 by means of clevis pin 42 which extends through the body or block 43 of assembly 28 and also through the clevis 40. Clevis 40 includes a socket 44 for receiving one end of heavy diagonal 26.

Sleeve 48 of diagonal 26 is demountably maintained within socket 44 by means of hinge pin 46. This pin 46 also prevents rotation of the sleeve 48 within socket 44.

In this embodiment of the present invention, the heavy diagonal 26 is longitudinally adjustable in order to adapt to a variety of placement conditions and situations. This adjustability is accomplished through the use of a diagonal screw 47 which is retractable within diagonal tube or sleeve 48. Adjustments in length are accomplished by rotating spanner nut 50. This spanner nut 50 threadably engages diagonal screw 47 and abuts a shoulder 51 of sleeve 48 such that diagonal screw 47 extends from or retracts within sleeve 48. Depression of diagonal 26 below the horizontal relative to the connector coupling assembly 28 is prevented by fixed pin 41 in order to avoid improper placement.

Diagonal 26 is connected to the swivel base 22 and to the foot of a scaffold post 32 (which includes its associated screw leg 52) through a clevis 54 carried on the swivel base 22. In the embodiment depicted in FIG. 1, swivel base clevis 54 is substantially the same as connector clevis 40 and is positioned on the opposite end of adjustable diagonal 26. Diagonal screw 47 is demountably maintained within socket 56 by means of hinge pin 58.

The hinge pins 46,58 permit different size diagonals 26 to be readily substituted in a given scaffolding assembly 20 and thus allow for interchangeability and ease of construction and installation.

Swivel base 22 is optionally provided with a base pad 60 interposed between the base plate 61 of swivel base 22 and the sloping boiler wall 24. This base pad 60 provides a cushion for the base and avoids damage or scarring of the boiler wall. This base pad 60 may be formed of any suitable material including plywood or neoprene.

Clevis 54 and screw leg 52 are both pivotally connected to base 22 through bolt 62. This advantageous arrangement provides for a more direct transferral of the horizontal component of that portion of the weight of the scaffolding latticework 63 borne by screw leg 52 into the inner scaffolding supports 32 and greatly simplifies installation and removal.

Figure 2:
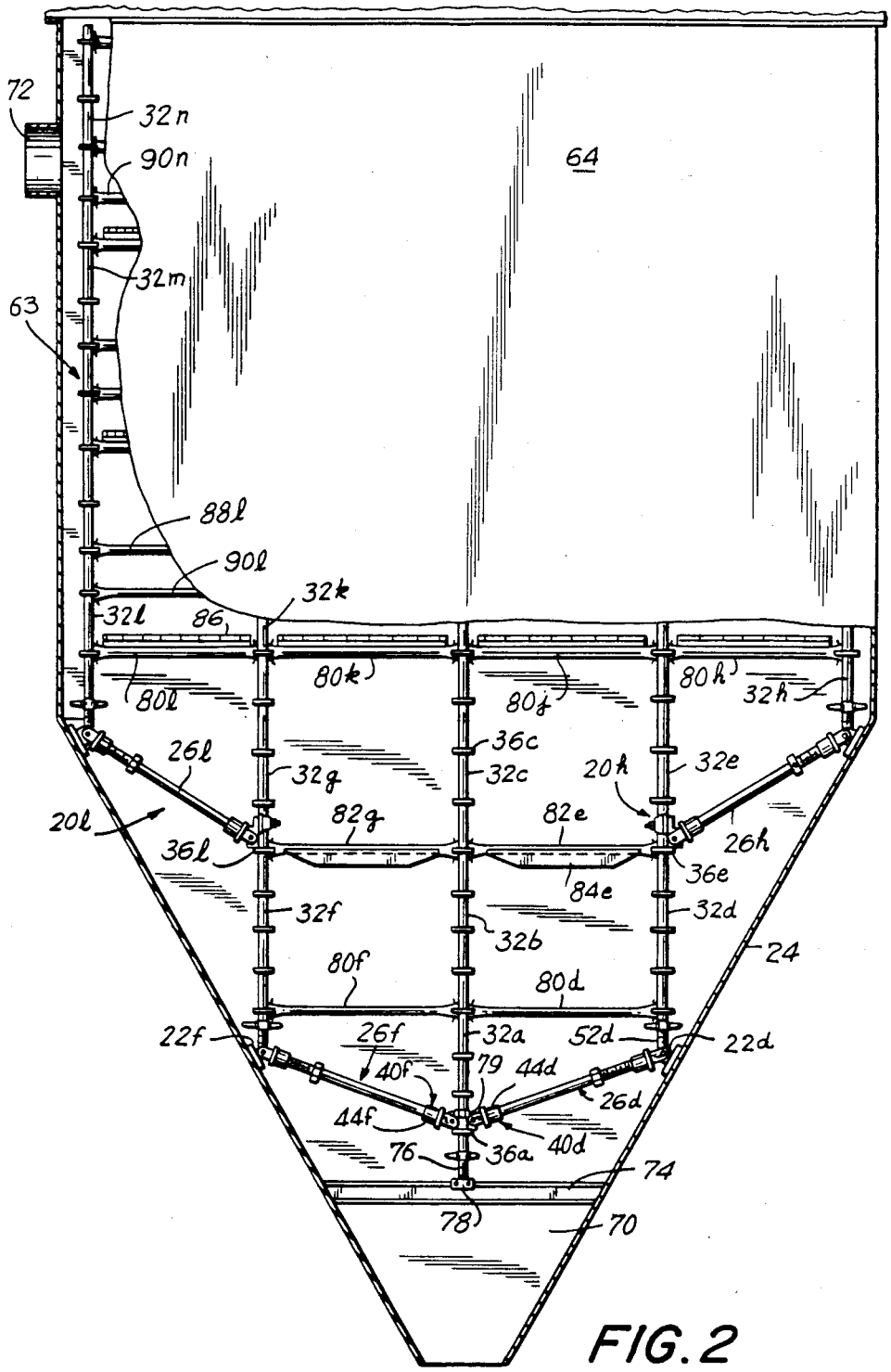
FIG. 2 is a cross-sectional side view of a boiler having a symmetrical scaffold latticework installed therein.

Referring next to FIG. 2, there is shown an exemplary installation of a boiler throat scaffolding system according to one embodiment of the present invention (incorporating scaffolding support assemblies 20 in a balanced array of the latticework 63). For convenient reference, each post 32 and its associated accessories are identified by a separate letter.

Boiler 64 comprises a generally rectangular firebox whose lower walls 24 converge toward a throat 70. Ash and other byproducts of combustion fall through this throat 70 into an ash pit (not shown) for collection and removal. Although this throat opening to the ash pit may be up to 2½ feet wide, this area often must be planked over to protect maintenance workers in the ash pit and is therefore not available as an access to the boiler. Alternatively, access to the interior of the boiler is gained through a manhole opening 72 provided in the sidewall of the boiler 64. This manhole 72 is typically quite small with diameters ranging from 18 to 30 inches. This limitation severely restricts the size and configuration of scaffolding components which can be passed through the manhole and assembled within the boiler.

In assembling the scaffolding latticework 63 according to one embodiment of the present invention, a support beam 74 is horizontally emplaced in the boiler throat 70 so as wedgingly to rest securely between opposite converging bottom walls 24. Screw leg 76 is then installed on a base saddle 78 to support vertical post 32*a*.

A double clevis connector coupling assembly 79 (see FIGS. 6A and 6B, discussed below) pivotally mounts opposing connector clevises 40*d*,40*f* and is fixed to the bottom central vertical post 32*a* at a single ring connector 36*a*. Adjustable diagonals 26*d*,26*f* are inserted and fixed into the adjacent pair of connector sockets 44*d*,44*f*, respectively. Diagonals 26*d*,26*f* may be adjusted independently to allow bases 22*d*,22*f* to seat advantageously on converging boiler walls 24 so as to assure that their respective screw legs 52*d*,52*f* are vertically aligned to provide proper support for their respective vertical posts 32*d*,32*f*. Further support and alignment for vertical posts 32 is provided by standard horizontal members 80. In this embodiment, these horizontal runners 80 are configured and assembled according to the teachings of U.S. Pat. No. 4,496,026.

Figure 6:
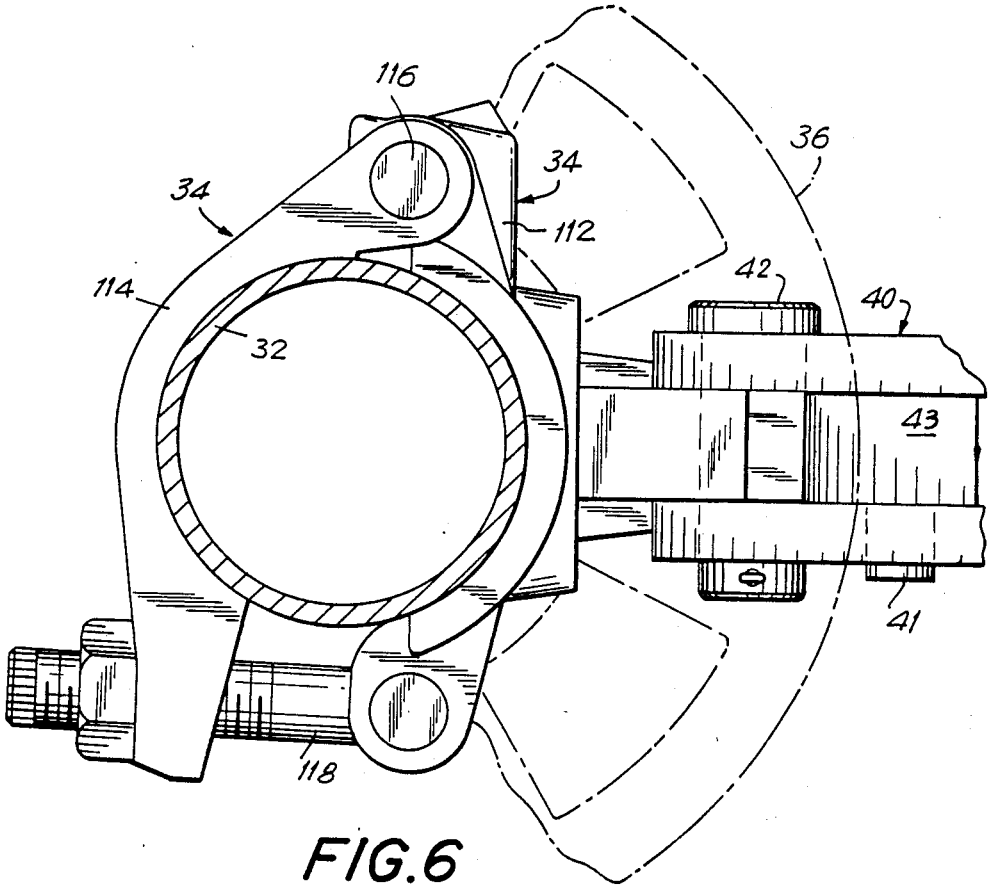
FIG. 6 is a plan view of the connector coupling assembly, showing the ring connector in dash-dot outline, taken in section through the vertical scaffold post along line 6—6 in FIG. 1.
Figure 6B:
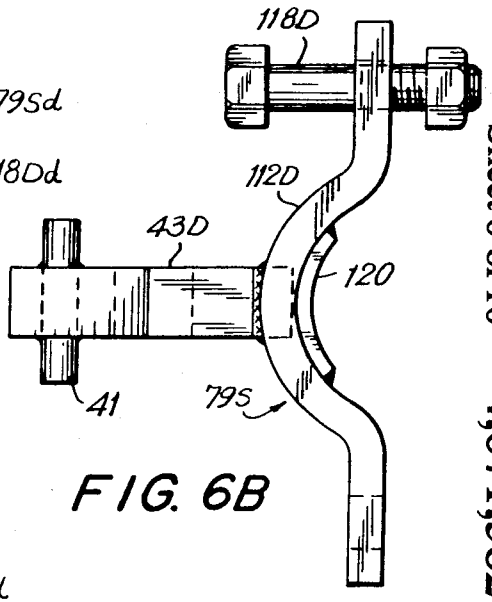
FIG. 6B is a plan view of a subassembly, being one-half of the double clevis connector coupling assembly of the type shown in FIG. 6A.
Figure 6A:
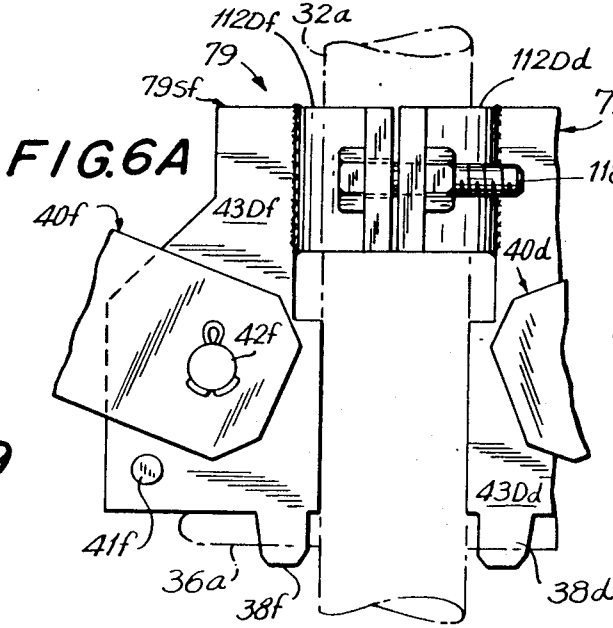
FIG. 6A is a side elevation of a double clevis connector coupling assembly useful for fastening two diagonals opposingly to a single ring connector.

The double clevis connector coupling assembly 79 shown in FIG. 6A is comprised of a pair of identical subassemblies 79S (see FIG. 6B). This identity of the subassembly reduces cost and inventory. The letter "D" has been added to reference numbers which are used on items similar to, but modified from, those used for the single clevis connector coupling assembly 28 shown in FIG. 6. The versatility of the double clevis assembly 79 illustrated in detail in FIG. 6A is best shown in the bottom center of FIG. 2. Proper design of scaffolding latticework using this novel system could be impossible as a practical matter in many boilers and similar scaffolding installations without the double clevis assembly 79. As shown in FIG. 6B, subassemblies 79Sf and 79Sd are clamped to post 32*a* by bolting the respective coupler bodies 112Df and 112Dd with bolts 118Df and 118Dd. At the same time the fingers 38*f* and 38*d* of blocks 43Df and 43Dd are secured in respective cutouts in connector 36*a*; thus pivotally joining clevises 40*f* and 40*d* to a single scaffolding post 32*a* at connector 36*a*. Note that shim 120 was used mainly to adapt an available standard coupler body 112D to the tube size of post 32*a*.

The modularized horizontal members 80 are of set length, e.g. eight feet for members, 80*d*,80*f*, and seven feet for 80*h*,80*l*. Each post 32 usually includes four ring connectors and typically are six and one-half feet high.

Referring again to FIG. 2, the vertical posts 32*h*,32*l* are fixed in position by the horizontals 80*h*,80*l*. The supporting swivel bases 22*h*,22*l* are secured at those positions by diagonals 26*h*,26*l*, respectively.

Figure 8:
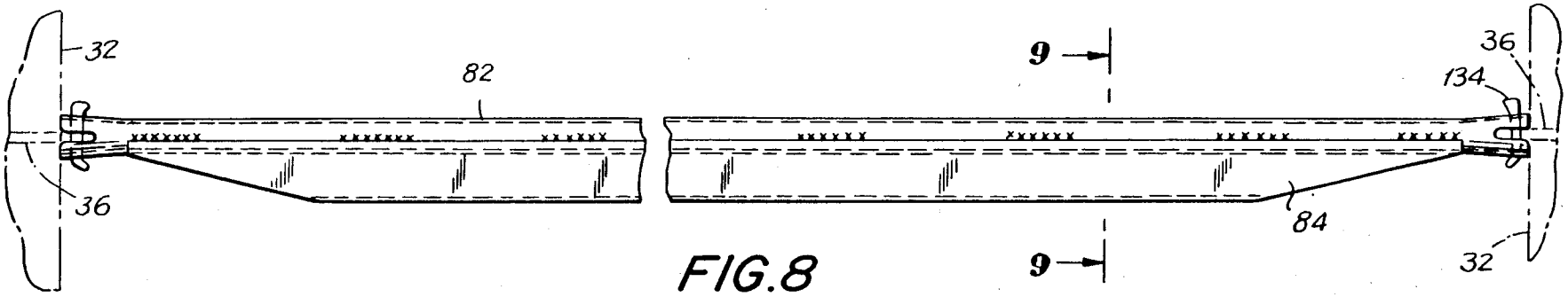
FIG. 8 is a side elevation of a heavy horizontal support member.
Figure 9:
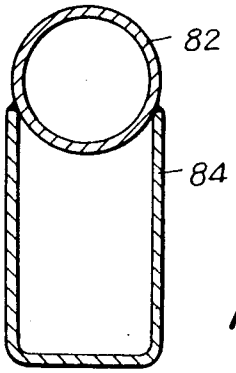
FIG. 9 is a sectional view taken along line 9—9 in FIG. 8 of the heavy horizontal member.

In order to advantageously transmit the horizontal component of the weight of the upper scaffolding latticework through the lower latticework, heavy horizontals 82*e*,82*g* are positioned at the ring connectors 36*e*,36*l* engaged by the diagonals 26*h*,26*l*. These heavy horizontals 82 (best shown in FIGS. 8 and 9) are standard horizontal members modified by added further structural support in the form of a welded U-shaped channel 84. Typically, heavy horizontals 82 are needed only if the spans between posts 32 are over five feet.

These HEAVY HORIZONTALS 82*e*, 82 *g* serve as abutment means for the respective diagonals 26*h*, 26*l*. Similarly, diagonals 26*d* and 26*f* serve as abutment means for each other.

Once the scaffolding support assemblies 20 are in place, working platforms may thereafter be constructed above the bottom walls 24 of the boiler 64. These platforms are formed by positioning support members 86 (usually in the form of wooden or aluminum planking) lengthwise across two or more horizontal members 80. These particularly extend laterally along the walls of the boiler. Where needed to meet code requirements, guard rails 88 and mid-rails 90 may be provided for the protection of workers on the platform. Preferably, these railing members are standard horizontal supports extending from ring connectors 36 along vertical posts 32 of the scaffold latticework 63. Normally, these railings would be perpendicular to the plane of the drawing and thus would not be seen; but have been included for purposes of illustration.

Figure 3:
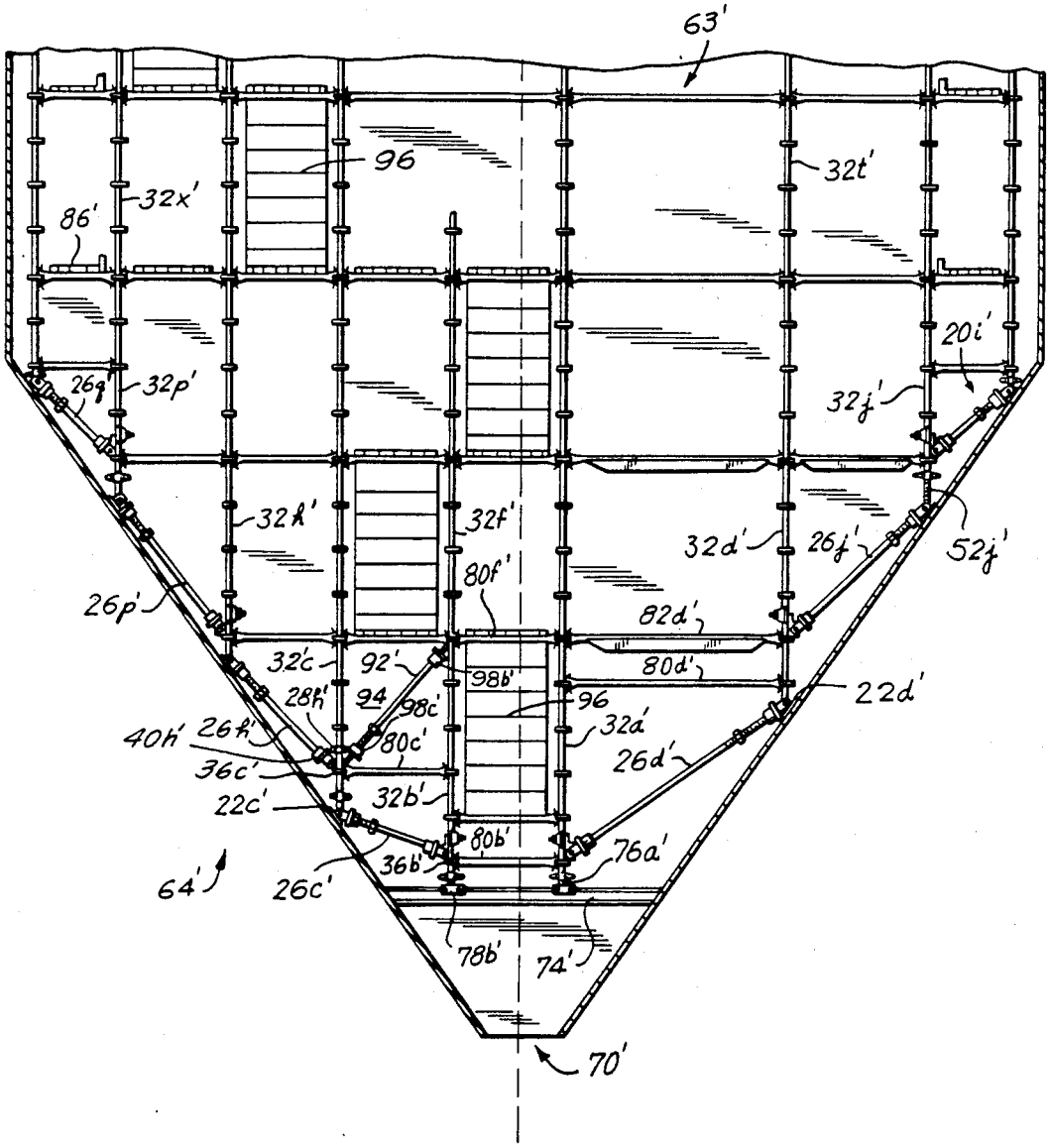
FIG. 3 is a cutaway side view of a boiler having an asymmetrical scaffold and staircase latticework installed therein.

FIG. 3 depicts a more typical application of one embodiment of the present invention. The asymmetrical configuration necessitated by the stairway as shown in this embodiment, or by features in the boiler itself, is more representative of typical applications of the present invention. For convenient reference, each post 32 and its associated accessories are again identified by a separate letter, plus a prime (') in order to differentiate from the lettered reference numbers of FIG. 2. Construction of the scaffold support assemblies 20 and latticework 63 is substantially similar to that described above with regard to FIG. 2. A support beam 74' must be initially installed in the boiler throat 70' so that it wedges in the converging boiler bottom walls 24. Screw legs 76*a*',76*b*' are then positioned along support beam 74 to provide bases for vertical posts 32*a*',32*b*'. The first ring connectors 36*a*', 36*b*' are tied together by horizontal member 80*b*'. Heavy diagonals 26*c*',26*d*' are secured to the other side of the connectors 36*b*',36*a*', respectively. As shown in FIG. 3, these diagonals may be provided in varying standard lengths to accommodate different sized bays. As used herein, the term "bays" denotes the rectangular areas within the scaffolding latticework defined by a pair of runner horizontals, and an adjacent pair of bearer horizontals (not shown) which latter run perpendicular to the plane of the drawing. Swivel bases 22*c*' and 22*d*' are pivotally attached to diagonals 26*c*' and 26*d*', respectively and serve as supports for vertical posts 32*c*' *and 32d', respectively.*

Where, due to boiler obstructions or scaffolding configurations, lateral support cannot be provided horizontally across the boiler throat along a given horizontal plane, an upward diagonal 92 may advantageously be employed to conduct primarily horizontal components of the weight of the scaffolding to the next inner post 32.

Figure 14:
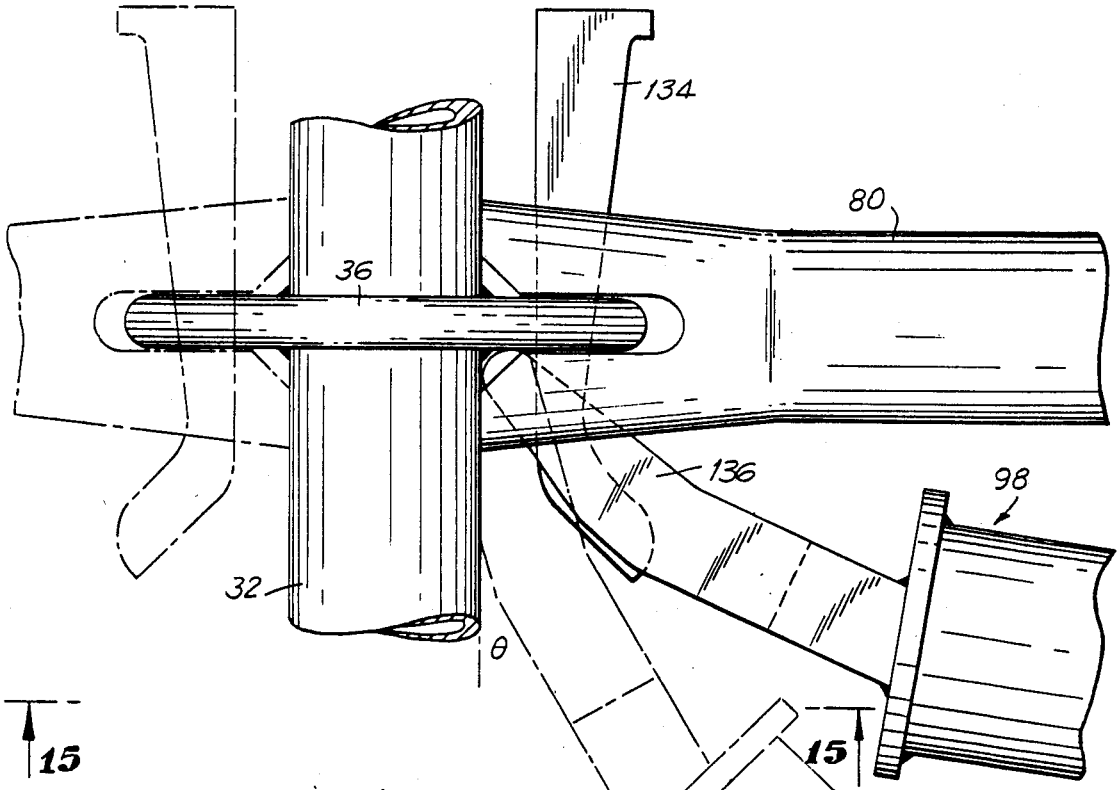
FIG. 14 is a side elevation in section of a load ring having two horizontal supports with locking wedges and a forked diagonal support in position thereon.
Figure 15:
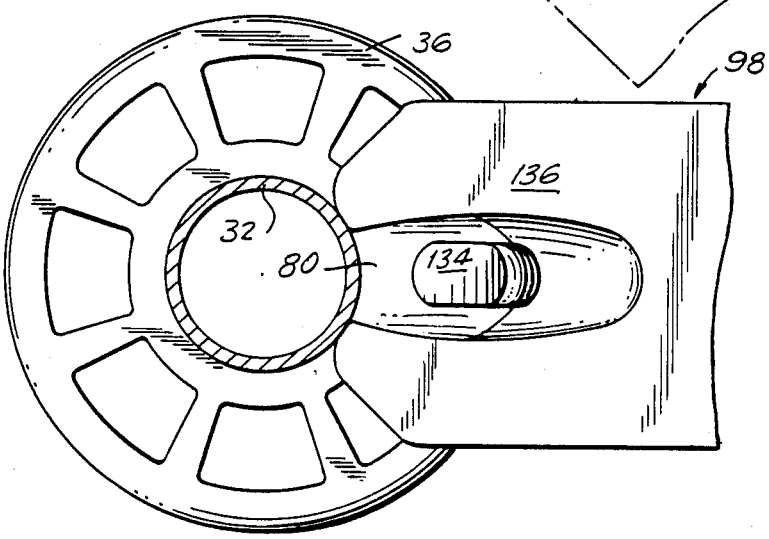
FIG. 15 is a bottom view taken along lines 15—15 in FIG. 14 of the connector ring and the forked end of the upward diagonal support.

This particular arrangement is clearly depicted in FIG. 3 at bay 94. Because stairway 96 interrupts the horizontal force transfer beyond horizontal member 80*c*', an upward diagonal 92' is provided to transmit the horizontal component of the force transmitted from downward diagonal 26*h*' to the next set of horizontals capable of being force balanced; namely, horizontal members 80*f*' and 82*d*'. In order to avoid dangerous components of torque, shear and/or stress, it is desirable to keep these forces in line in a single plane. This is accomplished in most applications simply by connecting diagonals and corresponding horizontals along the same vertical plane bisecting a common ring connector. However, where it is necessary to connect a horizontal and diagonal at the same point along the same vertical plane (as occurs at the intersection of diagonal 92' and horizontals 80c' or 80f' in FIG. 3), a unique forked end fitting 98 is mounted at either end of the upward diagonal 92'. This configuration allows the force transmission to take place along the same vertical plane. Detail of this forked end is best shown in FIGS. 14 and 15.

Because of the forked end fitting 98c' used at connector 36c' the connector coupling assembly 28h' joined to the opposite side of the same connector 36c' is only a single clevis assembly. However, it will be understand that clevis 40h' and fitting 98c' function like a double clevis assembly 79.

At least one such fitting 98 will always be needed on any upward diagonal, because a horizontal 80 will always occupy an upper ring connector 36 at the inner post 32.

The balance of the scaffolding supports and latticework is constructed in the same manner as that described in FIG. 2. Thus the horizontal force from diagonal 26j' balances the horizontal forces from diagonals 26p' and 26h' (via 92').

Figure 4:
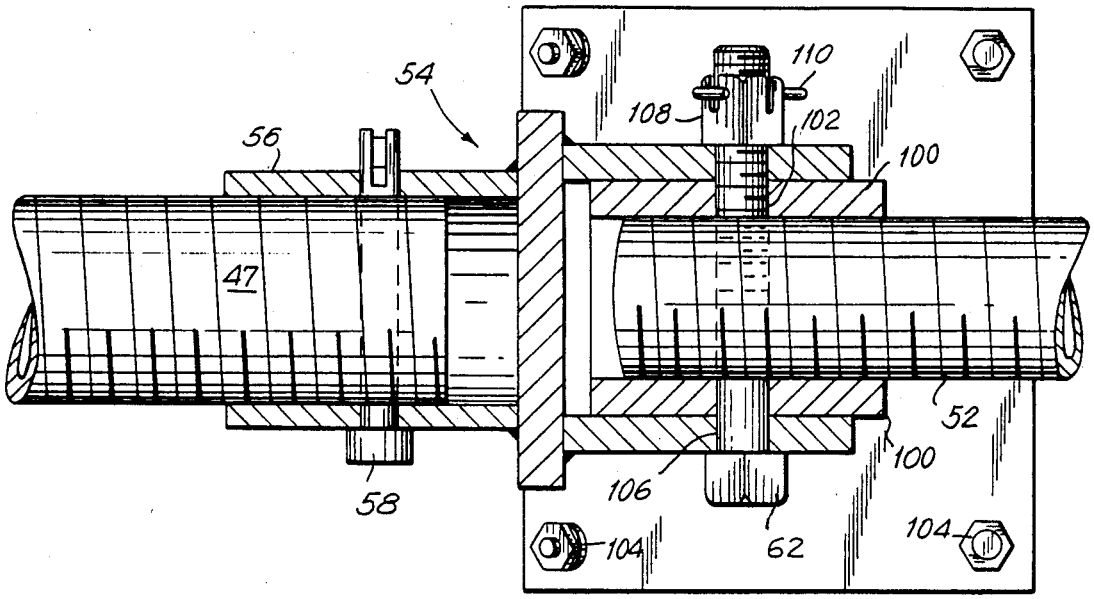
FIG. 4 is a partially sectioned view taken along angled line 4—4 in FIG. 1 of the swivel base.
Figure 7:
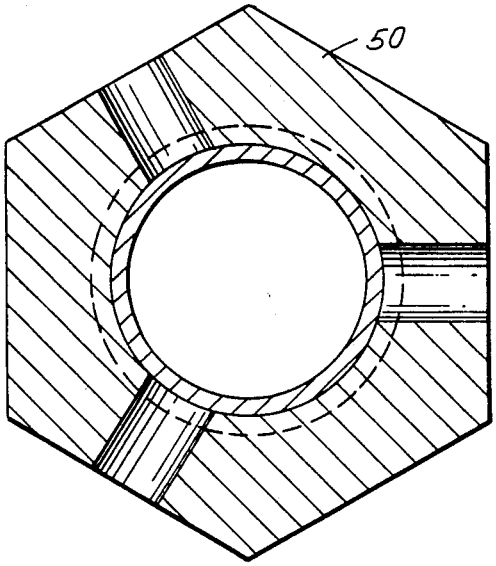
FIG. 7 is a cross sectional view taken along line 7—7 in FIG. 1 of the threaded adjusting nut on the diagonal.
Figure 5:
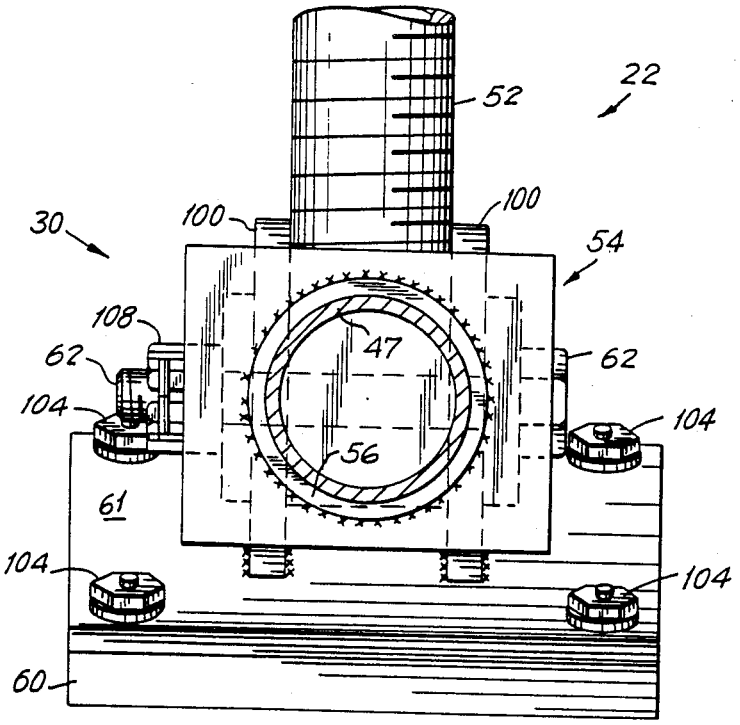
FIG. 5 is a cross sectional view taken along line 5—5 of the diagonal in FIG. 1 with an isometric view of the swivel base and attached vertical post.

FIGS. 4 and 5 are detailed views showing the design of the swivel base 22 according to the embodiment of the present invention shown in FIGS. 1 to 9. The base plate 61 is welded to two parallel legs 100 having a bore 102 therethrough. The swivel base 22 may optionally be provided with a base pad 60 secured to the base by means of four bolts 104. Swivel base clevis 54 and screw leg 52 are mounted to swivel base 22 by means of a bolt 62 which extends through bore 102, clevis bore 106 and screw leg 52 (best shown in FIG. 4). This bolt 62 is maintained in place by castle nut 108 and interlocking cotter pin 110.

FIG. 6 is a plan view of the connector coupling assembly 28, which secures the heavy diagonal 26 (not shown) to vertical post 32 and ring connector 36 (shown in phantom) through connector clevis 40. The connector block 43 is pivotally joined to the clevis 40 by pin 42. Block 43 is welded to the body 112 of coupler 34, which latter clamps to vertical post 32. Coupler 34 further comprises a cap 114, a pivot rivet 116 and a locking bolt 118.

Figure 10:
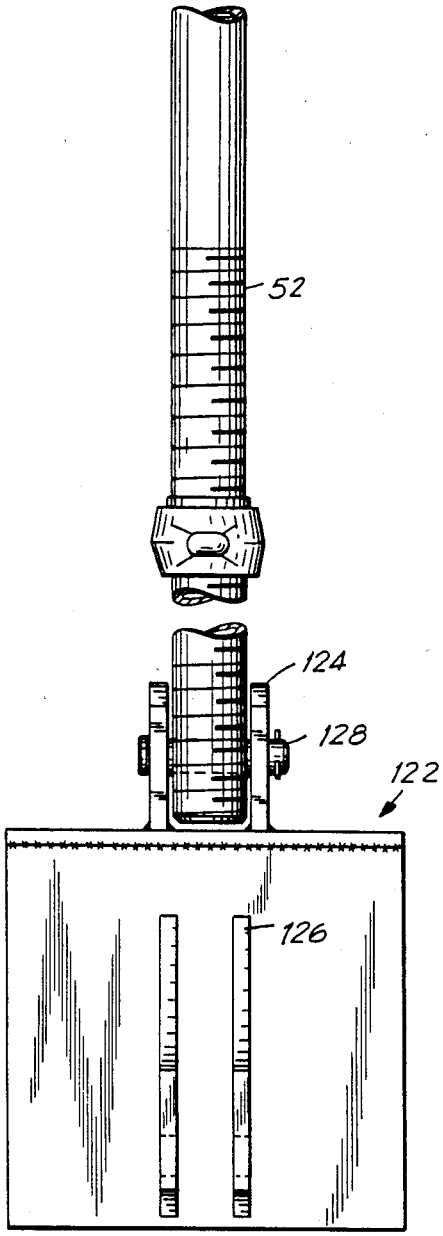
FIG. 10 is a frontal view of a triangularly shaped alternative embodiment of the novel swivel base.
Figure 11:
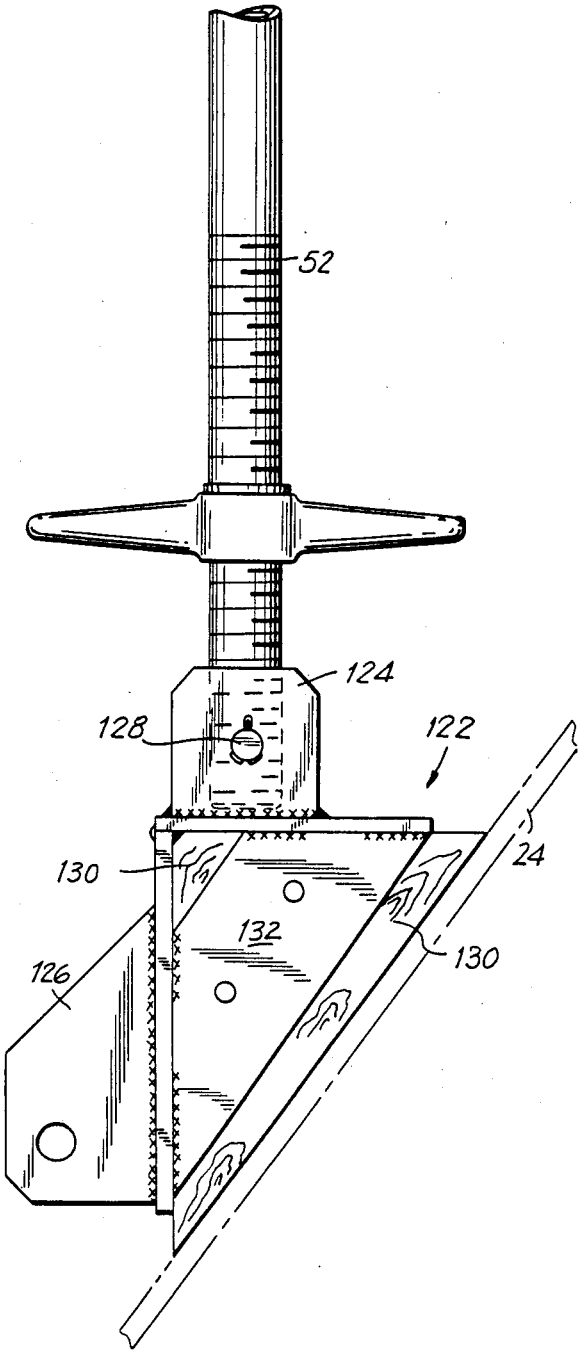
FIG. 11 is a side elevation of the triangular swivel base shown in FIG. 10.
Figure 12:
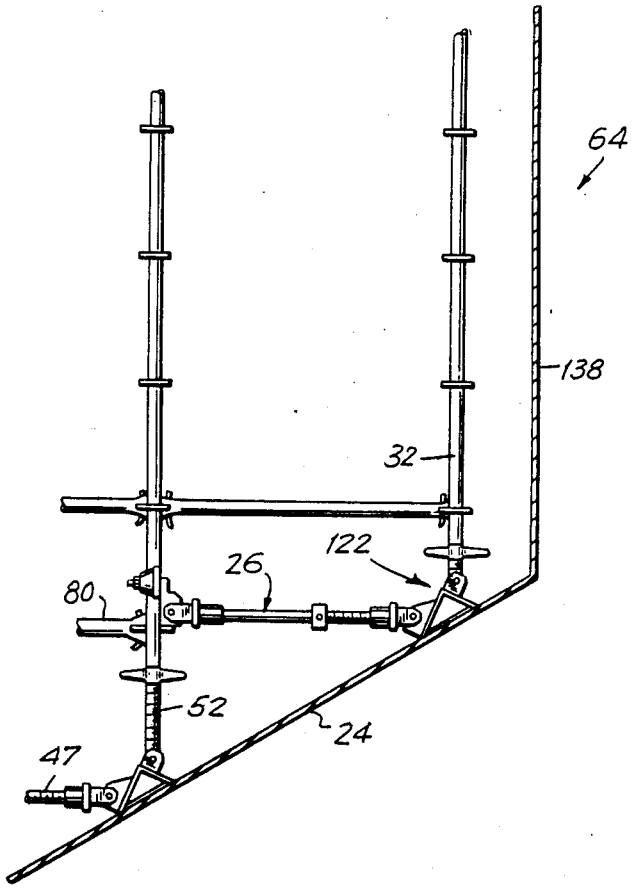
FIG. 12 is a sectional side elevation of a boiler interior containing a scaffolding system utilizing the triangular swivel base.

FIGS. 10, 11 and 12 depict an alternate embodiment of swivel base utilized to support the scaffolding latticework 63. The alternate base of this embodiment, indicated generally at 122, is in the form of an inverted right triangle having a clevis 124 positioned on its horizontal face and a second clevis 126 on its vertical face. Screw leg 52 is pivotally secured to clevis 124 by means of bolt 128. Clevis 126 is provided as a pivotal attachment point for an appropriate diagonal member (as shown at 26 in FIG. 12 or at 92 in FIG. 13).

A base pad 130 is optionally provided to protect the boiler walls 24. This pad 130 is shown as a triangular block of wood secured by the side plate 132. FIG. 12 shows a typical scaffolding support section utilizing the alternate right-triangular base 122.

Figure 13:
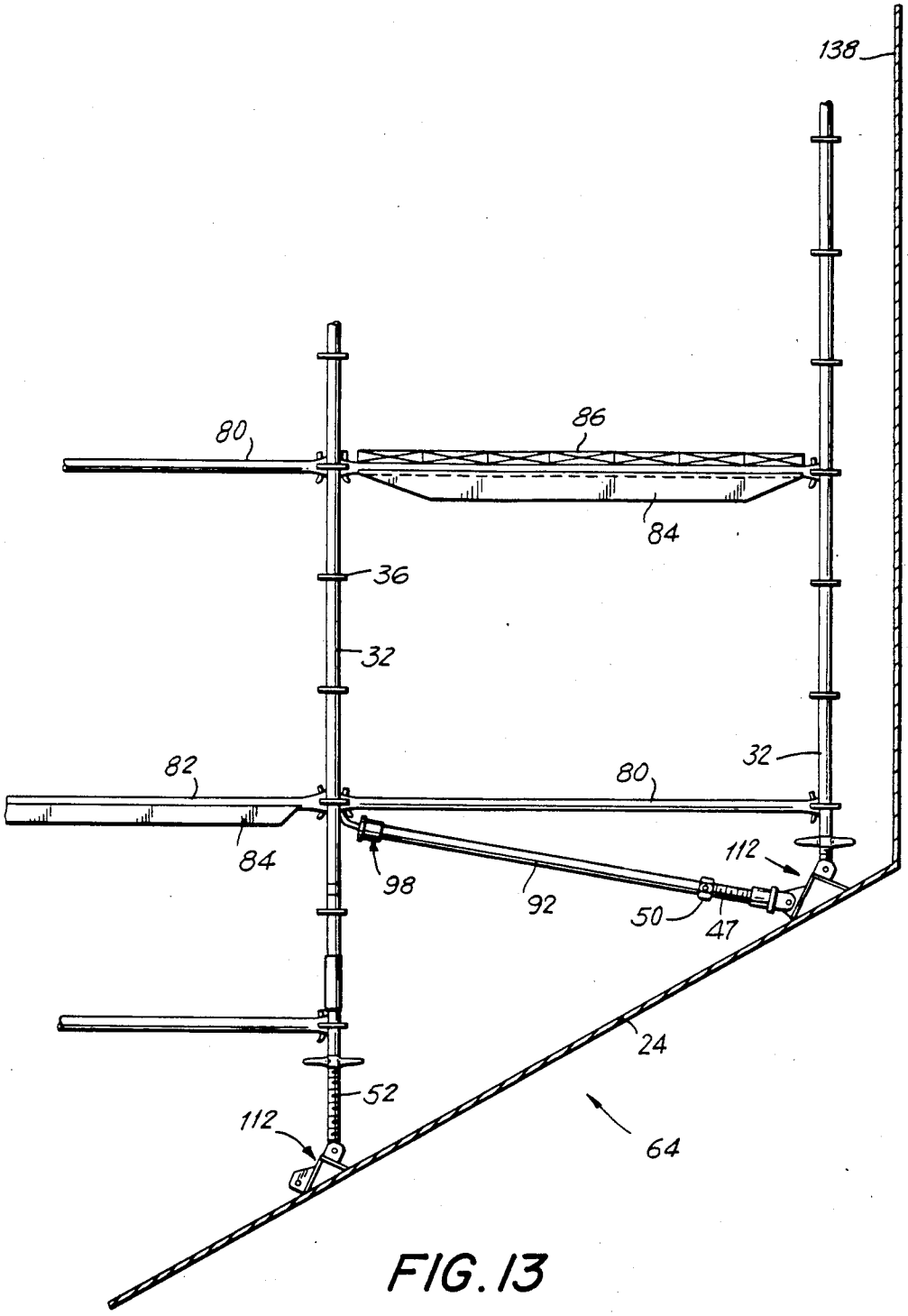
FIG. 13 is a sectional side elevation of a boiler interior containing a scaffolding system illustrating an alternative embodiment of the diagonal support which is fork-shaped and especially adapted for extending upwardly from the swivel base.

FIGS. 13, 14 and 15 show another embodiment of the present invention wherein diagonal members 92 transmit the horizontal and vertical components of the weight of the scaffolding latticework upward as previously explained briefly with respect to FIG. 3.

FIGS. 14 and 15 are detailed diagrams of the forked member 98 utilized where a horizontal member 80 and a diagonal 92 must be placed at the same point on the ring connector 36 of vertical post 32. Where diagonal member 92 with fork 98 attached is to impinge on vertical post 32 at a narrow vertical angle $\theta$, the fork 98 is positioned on the inside of locking wedge 134 as shown in phantom in FIG. 14 (with the tines 136 of the fork 98 on either side of the end of the horizontal 80). In the alternative, where the angle $\theta$is relatively large, the fork 98 may be positioned to straddle the locking wedge 134 also (as depicted in solid lines in FIG. 14).

The use of diagonals 26 for transmitting forces downwardly and the associated connector coupling assemblies 28 are preferred over the upward diagonals 92 and the associated forked fittings 98, because the assemblies 28 are positively clamped in place. Accordingly, fittings 98 could be modified to add a clamping strap or even a wedge-secured safety bridle (not shown). In any event, downward diagonals have been found preferable over upward diagonals, because they result in better loadings and force distribution.

Referring to FIG. 13, it will be understood that some boilers 64 do not have central throats 70 (as in FIGS. 2 and 3). There is a single bottom wall that slopes downwardly from one vertical wall 138 until it meets the opposing vertical wall (not shown) on the other side of the boiler. It will be recognized that the present invention is readily adapted for use in such a situation. In such a case, the lower horizontals 80 will be ultimately balanced against the opposing wall. In the absence of such an opposing wall or opposing sloped surface, other abutment means as will now be recognized can be substituted.

As seen in FIG. 12, the diagonal 26 can be oriented horizontally if the angle of the bottom wall etc. are appropriate to give this result. Similarly, it is within the scope of this invention to have two diagonals 26 placed in a horizontal plane (rather than in a vertical plane), for example at 90° to each other and at 45° to the direction of a given horizontal force so as to divide the force into two parts.

What is claimed is:

1. Scaffolding system for use on a sloping bottom surface, comprising:

a first vertical scaffold post on said sloping bottom surface, a second vertical scaffold post positioned in a direction down the slope of said surface when considered at the point of said first post, base means for supporting said first scaffold post on said sloping bottom surface without attachment to said bottom surface, diagonal means for rigidly bridging between at one end said base means and at the other end a position on said second vertical post so as to prevent said first vertical post from sliding down said sloping surface by bracing said base means with respect to said second vertical post, and abutment means effective at said position on said second vertical post for counterbalancing forces transmitted by said diagonal means to such position.

2. A system as claimed in claim 1, wherein said position on said second vertical post is no higher than the point at which said diagonal means joins said base means.

3. A system as claimed in claim 2, wherein said base means is a simple swivel base pivotally secured both to the foot of said first vertical post and to said one end of the diagonal means.

4. A system as claimed in claim 3, wherein said swivel base comprises a base plate, two upstanding legs attached to the top of said base plate in the form of a clevis, a bolt through the upstanding portion of said legs to pivotally join said base to the foot of said first vertical post, a clevis-and-socket pivotally joined by the clevis portion to the same bolt and by the socket portion to said one end of the diagonal means.

5. A system as claimed in claim 3, wherein said diagonal means is joined to said second vertical post by a connector assembly means.

6. A system as claimed in claim 5, wherein said connector assembly means comprises a coupler clamped to said second vertical post.

7. A system as claimed in claim 6, wherein said said second vertical post has at least one ring connector with at least one cutout, said connector assembly means further comprises a connector assembly body to which said coupler is affixed, a finger extension fitted into said cutout, a clevis pin through said body, a clevis-and-socket mounted pivotally on said clevis pin by said clevis portion and joined by the socket portion to the other end of the diagonal means.

8. A system as claimed in claim 1, wherein said diagonal means is a longitudinally adjustable diagonal brace which comprises an elongated diagonal support tube, an elongated diagonal screw leg telescoped within said tube, and a spanner nut on said diagonal screw leg abutting an end of said diagonal support tube.

9. A system as claimed in claim 4, wherein said diagonal means is a longitudinally adjustable diagonal brace which comprises an elongated diagonal support tube, an elongated diagonal screw leg telescoped within said tube, and a spanner nut on said diagonal screw leg abutting an end of said diagonal support tube.

10. A system as claimed in claim 9, wherein said said second vertical post has at least one ring connector with at least one cutout, and said system further comprises a connector assembly means for joining said diagonal means to said second vertical post which assembly means comprises a connector assembly body, a coupler affixed to said body and clamped to said second vertical post, a finger extension of said body fitted into said cutout, a clevis pin through said body, a clevis-and-socket mounted pivotally on said clevis pin by the clevis portion thereof and is joined by the socket portion thereof to the other end of the diagonal means.

11. A system as claimed in claim 10, further comprising a pair of hinge pins one of which joins the diagonal support tube to the socket portion of one of said clevis-and-sockets and the other of which hinge pins joins the diagonal screw leg to the other of said clevis-and-sockets.

12. A system as claimed in claim 1, for use in a boiler having sloped opposing bottoms walls which convergingly meet in an open throat, wherein said posts are part of a modularized post-and-runner scaffolding latticework etending across the width of said boiler including said throat and up both converging bottom walls as well as along the depth of said boiler in a rectangular array with each post which encounters said sloping walls having a respective second post connected by a respective diagonal means.

13. A boiler system as claimed in claim 12, wherein on each position on each respective second post a horizontal runner or another diagonal means is affixed opposite the first diagonal means at each such position to carry forces transmitted to such position by the first diagonal means on into the latticework along such subsequent additional horizontal runners and diagonal means as are aligned to run from one post to the next in the same vertical plane across the boiler until a balancing force is encountered from a diagonal means on the opposite side of the boiler which thereby functions as the respective abutment means.

14. A boiler system as claimed in claim 13, further comprising beam means for spanning said throat below said latticework and providing support for some of the posts in the vicinity of the throat.

15. A boiler system as claimed in claim 14, wherein the posts have ring connectors spaced vertically therealong at regular intervals to which said runners and diagonals are attached.

16. A boiler system as claimed in claim 15, wherein said base means is a simple swivel base pivotally secured both to the foot of said first vertical post and to said one end of the diagonal means, wherein said diagonal means is joined to said second vertical post by a connector assembly means, wherein said diagonal means is a longitudinally adjustable diagonal brace which comprises an elongated diagonal support tube, an elongated diagonal screw leg telescoped within said tube, and a spanner nut on said diagonal screw leg abutting an end of said diagonal support tube.

17. A system as claimed in claim 1, wherein said position on said second vertical post is higher than the point at which said diagonal means joins said base means.

18. A system as claimed in claim 17, wherein a horizontal runner is secured to said second vertical post at the same position that the diagonal means is joined to said second vertical post, wherein said diagonal means is a longitudinally adjustable upward diagonal brace which comprises an elongated diagonal support tube, an elongated diagonal screw leg telescoped within said tube, a spanner nut on said diagonal screw leg abutting an end of said diagonal support tube, and a two tined forked end piece dimensioned to fit securely in compression with a tine on either side of a horizontal runner affixed at that position.

19. A system as claimed in claim 18, wherein said upward diagonal brace has a two tined forked end piece at each end thereof.

20. A system as claimed in claim 3, wherein said swivel base has a protective friction pad secured to the bottom thereof to both aid the retention of the base on the sloping surface and also to protect the surface.

21. A system as claimed in claim 1, wherein said swivel base comprises a body portion having rectangularly shaped faces with two opposing right triangularly shaped sides, the acute angle of which triangular shape ranges from 30° to 45°, each rectangular face on the adjacent sides of the triangle opposite from the hypotenuse having thereon a respective clevis attachment, with the attachment on the shorter face being pivotally attached to the first vertical post and with the attachment on the longer face being pivotally attached to said one end of the diagonal means.

22. A scaffolding support assembly, comprising a swivel base adapted to be pivotally secured to the foot of a vertical scaffold post, a longitudinally adjustable diagonal brace pivotally secured to said swivel base, which diagonal brace comprises an elongated diagonal support tube, an elongated diagonal screw leg telescoped within said tube, and a spanner nut on said diagonal screw leg abutting an end of said diagonal support tube, and a connector assembly means joined to said diagonal brace and adapted to be pivotally secured to a second vertical post.

23. An assembly as claimed in claim 22, wherein said swivel base comprises a base plate, two upstanding legs attached to the top of said base plate in the form of a clevis, a bolt through the upstanding portion of said legs to pivotally join said base to the foot of said first vertical post, a clevis-and-socket pivotally joined by the clevis portion to the same bolt and by the socket portion to said one end of the diagonal brace, wherein said connector assembly means further comprises a connector assembly body, a coupler affixed thereto, a finger extension for fitting into a cutout for a post ring connector, a clevis pin through said body, a clevis-and-socket mounted pivotally on said clevis pin by said clevis portion and joined by the socket portion to the other end of the diagonal means, and wherein said diagonal brace is longitudinally adjustable and comprises an elongated diagonal support tube, an elongated diagonal screw leg telescoped within said tube, and a spanner nut on said diagonal screw leg abutting an end of said diagonal support tube.

24. A system as claimed in claim 5, wherein said vertical post has at least one ring connector with at least two cutouts on opposite sides of said post; said connector assembly means comprises a double clevis assembly comprised of two subassemblies each having a connector assembly body, a coupler portion affixed to said body, a finger extension fitted into a respective one of said opposing cutouts, a clevis pivotally mounted on said body, and fastening means clamping said subassemblies by said respective coupler portions to said second post such that each of said clevises is opposingly pivoted away from the other with one clevis joined to said other end of said diagonal means and the other clevis joined to said abutment means in the form of an opposing diagonal means.

25. A system as claimed in claim 24, wherein said diagonal means each is a longitudinally adjustable diagonal brace which comprises an elongated diagonal support tube, an elongated diagonal screw leg telescoped within said tube, and a spanner nut on said diagonal screw leg abutting an end of said diagonal support tube.

26. A boiler system according to claim 16, wherein said connector assembly means comprises at least one double clevis means at at least one ring connector which joins two opposing downward diagonal means to said connector symmetrically on opposite sides of the post of said connector.

* * * * *